United States Patent [19]
Brooke
Best Available Copy
[11] 4,238,066
[45] Dec. 9, 1980

[54] APPARATUS FOR STACKING SHEETS IN CORNER REGISTRATION

[75] Inventor: Edric R. Brooke, Bishops Stortford, England

[73] Assignee: Xerox Corporation, Stamford, Conn.

[21] Appl. No.: 32,439

[22] Filed: Apr. 23, 1979

[30] Foreign Application Priority Data

Apr. 27, 1978 [GB] United Kingdom ..... 16753/78

[51] Int. Cl.³ ..... B27F 7/17; B42C 1/12; B65H 29/22; B65H 31/30

[52] U.S. Cl. ..... 227/39; 227/99; 270/53; 271/184; 271/207; 271/272; 271/314; 414/35; 414/48; 414/90

[58] Field of Search ..... 271/314, 185, 184, 251, 271/207, 210, 225, 250, 272-274, 208, 209, 211, 213-215, 217-224; 414/54, 35, 90, 97, 48; 270/53; 227/99, 39; 198/416

[56] References Cited

U.S. PATENT DOCUMENTS

| | | | |
|---|---|---|---|
| 1,228,750 | 6/1917 | Crittenden | 271/213 |
| 2,190,417 | 2/1940 | Davidson | 271/251 |
| 2,901,249 | 8/1959 | Dexter et al. | 271/207 X |
| 3,107,089 | 10/1963 | Lockey | 271/251 |
| 3,175,824 | 3/1965 | Albosta | 271/251 |
| 3,502,255 | 3/1970 | Hermann et al. | 227/3 |
| 3,516,656 | 6/1970 | Sherman | 271/251 |
| 3,536,318 | 10/1970 | Gay et al. | 270/53 X |
| 3,690,537 | 9/1972 | Turner et al. | 227/83 |
| 3,709,595 | 1/1973 | Turner et al. | 270/53 X |
| 3,719,266 | 3/1973 | Korn et al. | 271/207 X |
| 3,758,104 | 9/1973 | Daily | 271/185 |
| 3,908,986 | 9/1975 | Bleau | 271/251 X |
| 3,929,327 | 12/1975 | Olson | 271/250 |
| 3,980,296 | 9/1976 | Craft et al. | 271/251 |
| 4,049,256 | 9/1977 | Church et al. | 271/251 X |
| 4,188,025 | 2/1980 | Gustafson et al. | 271/314 |

FOREIGN PATENT DOCUMENTS 976333 11/1964 United Kingdom ..... 271/185

OTHER PUBLICATIONS

Valehrach et al., "Document Feed," *IBM Tech. Disclosure Bulletin,* vol. 2, No. 3, Oct. 1959, p. 7.

*Primary Examiner*—Bruce H. Stoner, Jr.
*Attorney, Agent, or Firm*—William A. Henry, II

[57] ABSTRACT

Apparatus for stacking sheets in corner registration comprises a stacking surface inclined downwardly towards a registration corner and a pair of coacting sheet feed rolls of tapered cross-section adjacent the upper end of the stacking surface for directing sheets into the registration corner. With such an arrangement the sheets are so oriented that they present a leading corner to the registration corner along a line following the direction of advance and aimed into the registration corner. The rolls may be continuous or discontinuous.

3 Claims, 4 Drawing Figures

APPARATUS FOR STACKING SHEETS IN CORNER REGISTRATION

BACKGROUND OF THE INVENTION

This invention relates to sheet handling and more particularly to sheet stacking apparatus and methods.

Stacking apparatus typically act on sheets fed serially thereto to stack the sheets in registration with each other so as to provide an attractive and compact set or signature with uniform edges. For complete registration the sheets need to be aligned both laterally and longitudinally. This may be achieved by registering two adjacent edges (one end and one side) of the sheet with respect to respective registration stops and this form of registration is termed corner registration.

Stacking apparatus may be required in addition to compiling the sheets into sets to position the sheets with respect to a fixed finishing device such as a stitcher, stapler or punch. This is readily achieved by corner registration.

It is an object of the present invention to provide a stacking apparatus and method for corner registering sheets.

SUMMARY OF THE INVENTION

The invention provides apparatus for stacking in corner registration sheets being serially advanced edge first, comprising a registration corner, a stacking surface inclined downwardly towards the registration corner, and sheet gripping means for rotating each sheet in a controlled manner so as to present a leading corner of the sheet to the registration corner along a line following the direction of advance.

Preferably the sheet rotating means comprises cooperating rotating surface means between which the sheets are gripped.

The sheet rotating means may operate to rotate sheets of different sizes by different amounts in which case the rotating means and the disposition of the registration corner is suitably matched to a range of sheet sizes intended to be used with the apparatus.

In one form, apparatus according to the invention comprises a registration corner, a stacking surface inclined downwardly towards the registration corner, means for serially advancing sheets edge first along a path towards the stacking surface, and means adjacent the upper end of the surface for rotating each sheet in turn by an amount depending upon the size of the sheet, whereby at least two different sizes of sheet are differentially rotated such that, following rotation, their leading corners are aimed along substantially the same line into the corner.

Advantageously, the means for directing sheets to said corner comprises a pair of coacting sheet feed rolls of tapered cross-section adjacent the upper end of the stacking surface. Such an arrangement enables sheets to be so oriented that they present a leading corner to the registration corner along a line following the direction of advance and aimed into the registration corner. The action of passing the sheets through the tapered rolls causes it to skew in a controlled manner as it advances.

By suitable choice of taper angle it is possible to ensure for given paper sizes within a range the skewing and forward feeding will result in a uniformity of presentation of the leading sheet corner to the registration corner.

In a preferred form the registration corner is diagonally opposite the rolls and the corner is formed by registration fences along the flanking edges of the support surface which present a V-shaped receptacle to sheets exiting the rolls. The apparatus suitably includes a binding device, e.g. stapler or stitcher, for corner binding sets compiled on the support surface and one or both of the registration fences may be retractable for removing bound sets.

From another aspect, the invention provides a method of stacking sheets in corner registration, comprising serially advancing sheets edge first towards a registration corner and rotating each sheet in a controlled manner during its advancing movement so that the sheet presents a leading corner to the registration corner on a line following the direction of advance and aimed into the registration corner.

BRIEF DESCRIPTION OF THE DRAWINGS

In order that the invention may be more readily understood, reference will now be made to the accompanying drawings, in which.

DETAILED DESCRIPTION OF THE INVENTION

Figures 1, 3, 4:
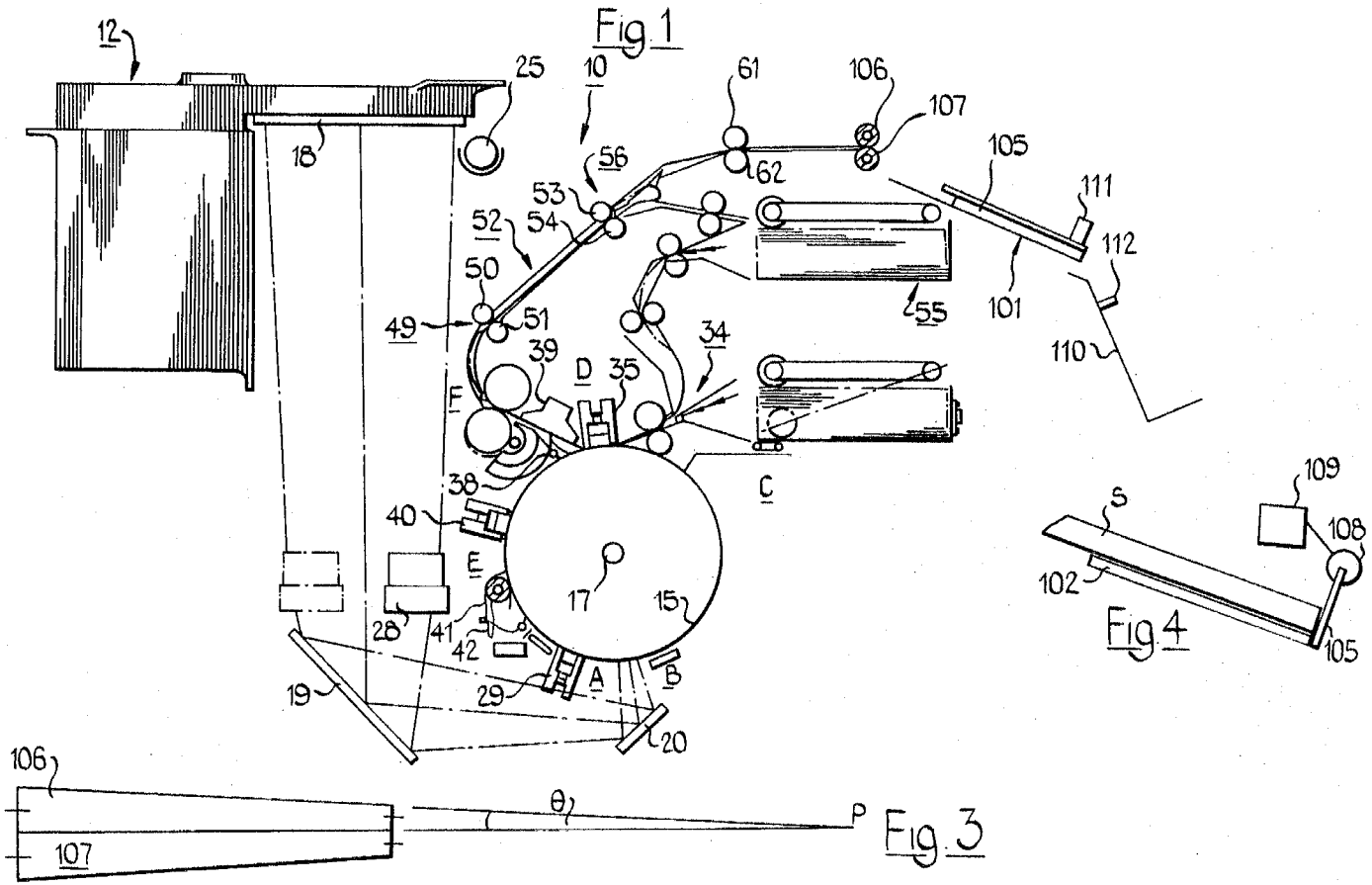
FIG. 1 is a schematic side elevation of an exemplary form of photocopier incorporating one embodiment of sheet stacker of this invention.
FIG. 3 is a schematic end view of the apparatus showing the sheet feed rolls.
FIG. 4 is a schematic view illustrating a retractable registration fence.

Referring to FIG. 1 there is shown an automatic xerographic reproducing machine 19 incorporating a sheet stacker according to this invention. The copying machine 10 is capable of producing either simplex or duplex copies in sets from a wide variety of originals which may be advanced in recirculating fashion by recirculating document apparatus 12 described in U.S. Pat. No. 3,556,512. Although the present invention is particularly well suited for use in automatic xerography, the apparatus is equally well adapted for use in any number of devices in which cut sheets of material are delivered in a set or stack and the set then separated from a previous set and forwarded to an output tray.

The processor 10 includes a photosensitive plate comprising a photoconductive layer over a conductive backing. The plate is formed in the shape of a drum 15 mounted on a shaft 17 journalled for rotation in the machine frame. The xerographic drum is rotated in the direction indicated so as to pass sequentially through a series of xerographic processing stations. The photosensitive drum and the xerographic processing apparatus are driven at predetermined speeds relative to each other from a single drive system (not shown) and the operations thereof coordinated in order to produce proper cooperation of the various processing mechanisms.

A document to be reproduced is transported by document handling apparatus 12 from the bottom of a stack to a platen 18 and scanned by means of a moving optical scanning system to produce a flowing light image. After scanning the document is returned and the next advanced and scanned and so on until the entire document stack has been copied at which time the cycle may be repeated as described in the above patent. The scanning system includes an elongated horizontal extended aperture lamp 25 and a movable lens element 28. The lamp and lens element move in coordination across the document supported upon the platen to focus successive incremental bands of illumination reflected from the document onto the moving drum surface. The optical path is folded by means of a pair of image mirrors 19 and 20 interposed between the lens and the drum surface and arranged to place the image on the drum at exposure station B. Prior to the imaging of the drum surface, the drum is first uniformly charged by means of a corona generator 29 at charging station A. Under the influence of the flowing light image, the uniformly charged photoconductive surface is selectively dissipated in the non-imaged areas to form a latent electrostatic image.

The latent electrostatic image is carried on the drum surface from the exposure station into the developing station C where it is developed into visible form by applying developer material to the surface using one of the various well-known xerographic systems of development.

The moving drum surface next transports the developed xerographic image to a transfer station D. Cut sheets of paper are also moved into the transfer station from sheet registering apparatus 34 in synchronous relation with the image on the drum surface. At the transfer station, transfer corotron 35 induces on the sheet a charge having a polarity and magnitude sufficient to attract the toner material from the drum surface to the sheet. This induced charge also electrostatically tacks the final support material to the drum surface and in order to remove the copy sheet from the drum surface, a stripper finger 38 is positioned downstream from the transfer corotron to lift the sheet from the drum surface. The stripped sheet is directed along a predetermined path of travel into contact with a stationary vacuum transport 39.

Residual toner remaining on the drum surface after transfer is removed into a cleaning station E which includes a cleaning corotron 40 and a mechanical cleaning device such as a brush 41 (as shown) or a blade.

The copy sheet, which has been removed from the drum surface after the transfer operation, is moved along stationary transport 39 into fusing station F.

Upon leaving the fuser, the fixed copy sheet is passed through a curvilinear sheet guide system, generally referred to as 49, into cooperating advancing rolls 50 and 51. The advancing rolls forward the sheets through a linear sheet guide system 52 into a second pair of advancing rolls 53 and 54. At this point, depending on whether simplex or duplex copies are desired, the simplexed copy sheet is either forwarded directly to the stacker 100 via pinch rolls 61, 62 or into upper supply tray 55 by means of a movable sheet guide 56 before the finishing apparatus for the duplexed copy. Movable sheet guide 56, and associated advancing rolls are prepositioned by appropriate machine logic system to direct the individual sheets into the desired path. The sheets are conveyed through the machine in centre line registration.

The stacking apparatus comprises a tray 101 having a base or support surface 102 inclined downwardly towards a registration corner 103 defined by registration fences 104, 105 extending along the lower sides of the tray. At the upper end of the support surface is arranged a pair of coacting sheet feed rolls 106, 107 arranged to receive sheets fed along a path by pinch rolls 61, 62. The rolls 106, 107 are of tapered cross-section, both tapering in the same direction, and are arranged so that the nip line is parallel to the nip line of the pinch rolls 61, 62.

The tray 101 is rotated through 45 degrees relative to the taper rolls 106, 107 so that the registration corner is diagonally opposite the rolls and the tray 101 presents a V-shaped receptacle to sheets exiting the rolls. The registration fences 104, 105 are retractable to enable assembled sets of sheets to be ejected into an output or collection tray 110.

Figure 2:
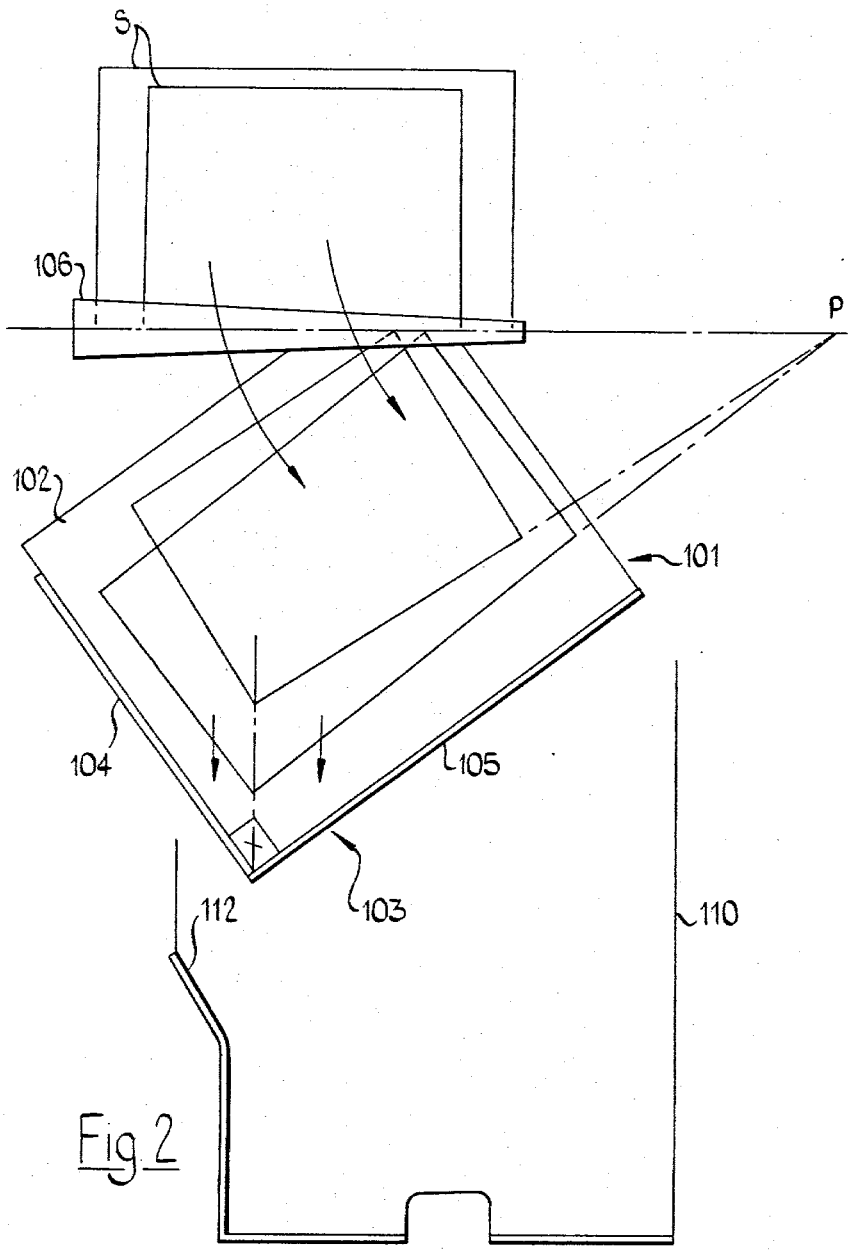
FIG. 2 is a schematic top view of the stacker of FIG. 1.

The general principles of operation of the apparatus will now be described. Sheets S fed along the path enter the nip of taper rolls 106, 107. As they pass between the rolls, the sheets are skewed in a controlled manner (due to the roll surface speed variation along the nip). The sheets are positively gripped between the rolls throughout their rotational movement and pass through the nip in a straightforward rolling manner without scuffing. The point P is the intersection of the projected surface lines of the tapered rolls. Since the sheets enter the nip between the rolls with their leading edges parallel to the nip, the leading edge is always radially disposed with respect to the pole P throughout its rotation. As the sheet is released by the nip, it travels down the stacking surface with its leading corner directed on a line aimed into the registration corner. FIG. 2 shows how continued movement of the skewed sheet results in it aligning against the registration fences 104, 105. The degree of rotation depends on the taper angle $\theta$ of the rolls and as will be seen from FIG. 2 also depends upon the size of the sheet itself. By suitable choice of taper angle and disposition of the registration corner, the apparatus may act to direct sheets of a range of sizes into the registration corner. Further, the apparatus may be matched to a particular sheet so that sheets of that size are aimed directly at the registration corner. The taper angle will usually be between about 3 degrees and about 10 degrees.

By suitable choice of the taper angle of the rollers, the rotational variation of the sheet in dependance upon size may be used so to rotate sheets of specified sizes that following rotation their leading corners are aimed into the registration corner along substantially the same line, as shown in FIG. 2. For example, for sheets of $8\times10\frac{1}{2}$ inches and $8\frac{1}{2}\times14$ inches, a taper angle $\theta$ of 4.5 degrees will produce a differential rotation of such sheets that when rotated they advance with their leading corners along approximately the same line. By suitably positioning the registration corner, the sheets may be aimed directly at the apex of the corner, although it will be understood that in practice the sheet movement will only approximate to this line due to variables such as misalignment of sheets entering the rolls and tolerance variations.

While it is preferable that the apparatus be designed so that sheets are aimed as nearly as possible into the apex of the corner, this is not essential and the downwardly sloping attitude of the stacking surface permits sheets entering the corner to slide downwards to align against both registration fences. If desired this may be assisted by jogging the sheets, for example by means of a vibrator 109 coupled to one or both of the registration fences.

After the required number of sheets has been compiled into a set in the tray 101, the set may be bound, such as by insertion of a corner staple or stitch by a binding device schematically represented at 111. Completed sets may be collected in ouput tray 110 and for ejecting set into the tray 110, the fences 104, 105 are retractable. For example as shown in FIG. 4, each fence may be supported from a rotatable shaft 108. If necessary, the stapled sets can be given a corrective deskewing movement on their way to the output tray 110 by means of a fixed stop or face 112 arranged to obstruct one edge of the set. An alternative way of deskewing the sets would be to pass them through a second pair of coacting tapered rolls arranged in the opposite sense to the pair 106, 107.

It will be understood that various changes and modifications may be made to the specific details without departing from the scope of the invention as defined in the appended claims. For example, in a modification, the nip rolls 106, 107 may be angled with respect to the rolls 61, 62.

Further, although the sheets are shown in FIG. 2 as being fed to the nip rolls long edge first, the sheets may equally well be fed short edge first.

Additionally, although the nip rolls 106, 107 are shown as continuous, one or both of them may be interrupted or discontinuous, being formed by a seris of spaced rollers arranged side-by-side on a common axis and each having a tapered surface corresponding to a portion of the continuous tapered surface illustrated.

The registration fences may be discontinuous.

What is claimed is:

1. Apparatus for stacking sheets in corner registration, comprising: coacting opposed sheet feed means of tapered cross-section and spanning the total width of a paper path adapted to receive sheets fed from a feed source and forward the sheets through said paper path for further processing, said tapered feed means, due to said tapered cross-section, rotating the sheets in the planes thereof individually by approximately 45° as they are forwarded with the sheets being positively gripped throughout their rotational movement such that they pass through a nip formed between said coacting feed means in a straightforward rolling manner; and stacking means located downstream from said coacting sheet feed means and adapted to receive the sheets forwarded by said coacting feed means, said stacking means being downwardly inclined in relation to said coacting feed means and including a registration corner means diagonally opposite said feed means, said registration corner means being rotated 45° in relation to said coacting feed means such that a V-shaped intersection is presented thereby to incoming sheets to said stacking means whereby sheets forwarded toward said registration corner means by said coacting feed means are forwarded with a corner thereof in line with said registration corner means V-shaped intersection.

2. The apparatus of claim 1 wherein said registration corner means is defined by registration fences which present said V-shaped intersection for sheets exiting said coacting feed means, at least one of said fences being retractable for removing sets compiled in said corner, and further including output tray means arranged to receive sets from said registration corner means upon retraction of said fences and having means arranged to act on a set of sheet entering said output tray to align the set of sheets with said tray.

3. The apparatus of claim 2 including means for stapling the set of sheets in said stacking means.

* * * * *